US007152739B1

(12) United States Patent
Burleson

(10) Patent No.: US 7,152,739 B1
(45) Date of Patent: Dec. 26, 2006

(54) DENTAL APPLIANCE STORAGE ASSEMBLY

(75) Inventor: Michael Burleson, Arlington, TX (US)

(73) Assignee: Tube Decor/By Innerface Concepts, Inc., Waussau, WI (US)

( * ) Notice: Subject to any disclaimer, the term of this patent is extended or adjusted under 35 U.S.C. 154(b) by 328 days.

(21) Appl. No.: 10/719,242

(22) Filed: Nov. 21, 2003

(51) Int. Cl.
*A45D 44/18* (2006.01)

(52) U.S. Cl. ..... 206/581; 206/15.2; 132/309

(58) Field of Classification Search ..... D4/104–113; D6/528–531, 534; 132/308, 309, 311; 206/217, 206/227, 229, 581, 361, 362.2, 367.3, 15.2, 206/15.3; 15/184
See application file for complete search history.

(56) References Cited

U.S. PATENT DOCUMENTS 1,155,343 A 10/1915 Ekman et al.
2,775,250 A * 12/1956 Oxenrider ..... 132/308
4,285,151 A * 8/1981 Gertler ..... 40/455
4,957,125 A * 9/1990 Yaneza ..... 132/309
D345,824 S * 4/1994 Fitz ..... D28/67
5,630,505 A 5/1997 Garcia
5,670,730 A * 9/1997 Grewe et al. ..... 84/609
5,845,104 A * 12/1998 Rao ..... 711/113
5,864,288 A * 1/1999 Hogan ..... 340/568.1
6,186,324 B1 * 2/2001 Catterson ..... 206/362.1
6,976,623 B1 * 12/2005 Mambakkam et al. ..... 235/441

* cited by examiner

*Primary Examiner*—Mickey Yu
*Assistant Examiner*—Jerrold Johnson
(74) *Attorney, Agent, or Firm*—Jeffrey A. Proehl; Woods, Fuller, Shultz & Smith, P.C.

(57) ABSTRACT

A dental appliance storage assembly includes a base, a floss dispenser, and a tubular storage assembly having a conical bottom surface for holding a toothbrush in a non-vertical orientation within the tubular storage assembly.

15 Claims, 3 Drawing Sheets

DENTAL APPLIANCE STORAGE ASSEMBLY

BACKGROUND OF THE INVENTION

1. Field of the Invention

The present invention relates to dental appliance storage devices and more particularly pertains to a new dental appliance storage assembly for storing a toothbrush and dental floss in a sanitary manner.

2. Description of the Prior Art

The use of storage devices is known in the prior art. U.S. Pat. No. 1,155,343 describes a tubular toothbrush holder having a screw on bottom cap and a circumferential protrusion to facilitate hanging the holder from a wall bracket. Another type of storage device is U.S. Pat. No. 4,214,657 discloses a multiple chamber toothbrush holder and sterilizer. U.S. Pat. No. 5,630,505 discloses a ventilated toothbrush holder cover assembly for placement over a cup-type toothbrush holder. U.S. Pat. No. 5,864,288 discloses a talking toothbrush holder that produces a sound for a predetermined amount of time upon the removal of the toothbrush from the holder.

While these devices fulfill their respective, particular objectives and requirements, the need remains for a multipurpose toothbrush holder that can provide audio entertainment as a guide to proper brushing length and stores a toothbrush and floss in a sanitary yet entertaining manner to promote use by children.

SUMMARY OF THE INVENTION

The present invention generally comprises a base, a floss dispenser, and a tubular storage assembly having a conical bottom surface for holding a toothbrush in a non-vertical orientation within the tubular storage assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
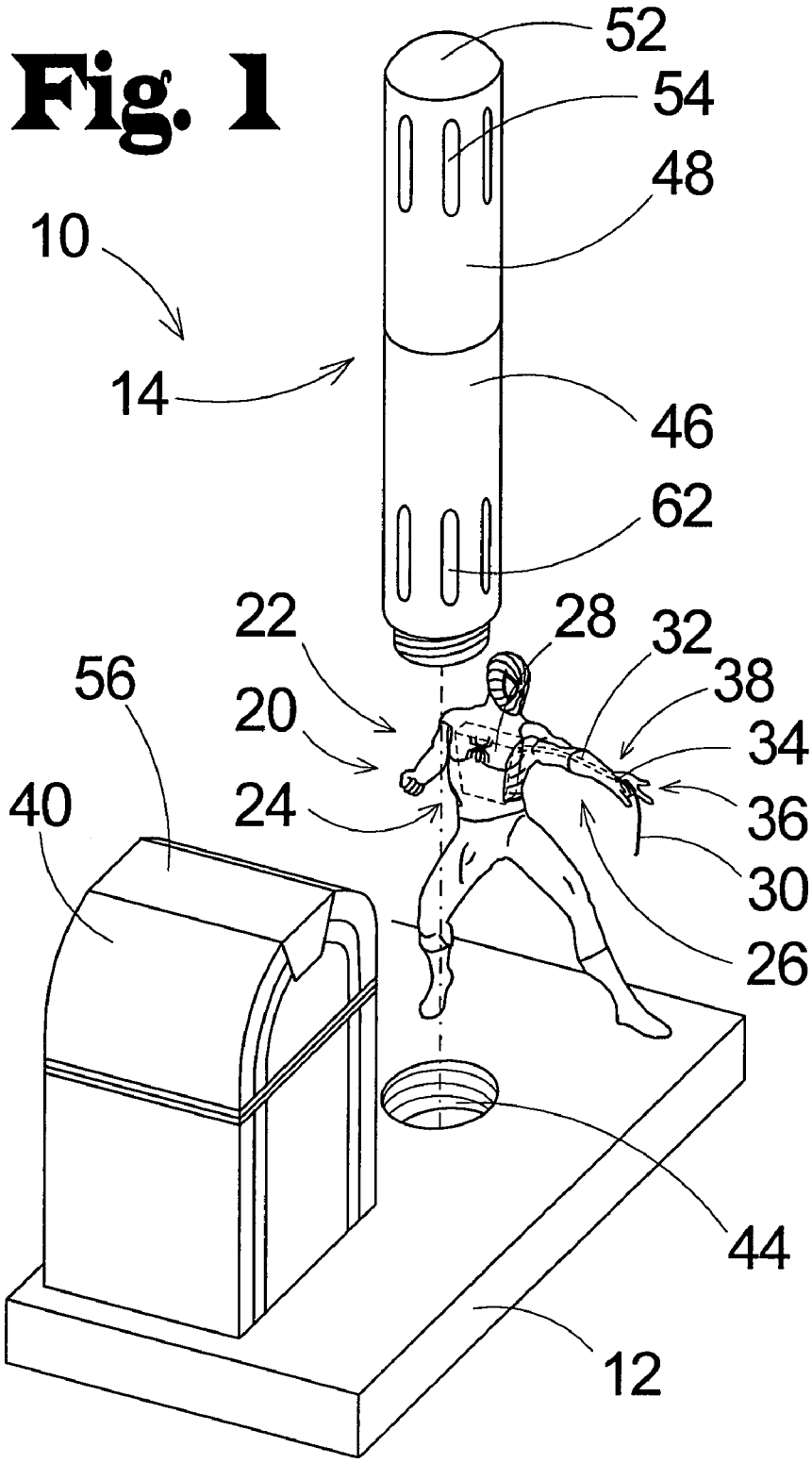
FIG. 1 is a partially exploded perspective view of a new dental appliance storage assembly according to the present invention.
Figure 2:
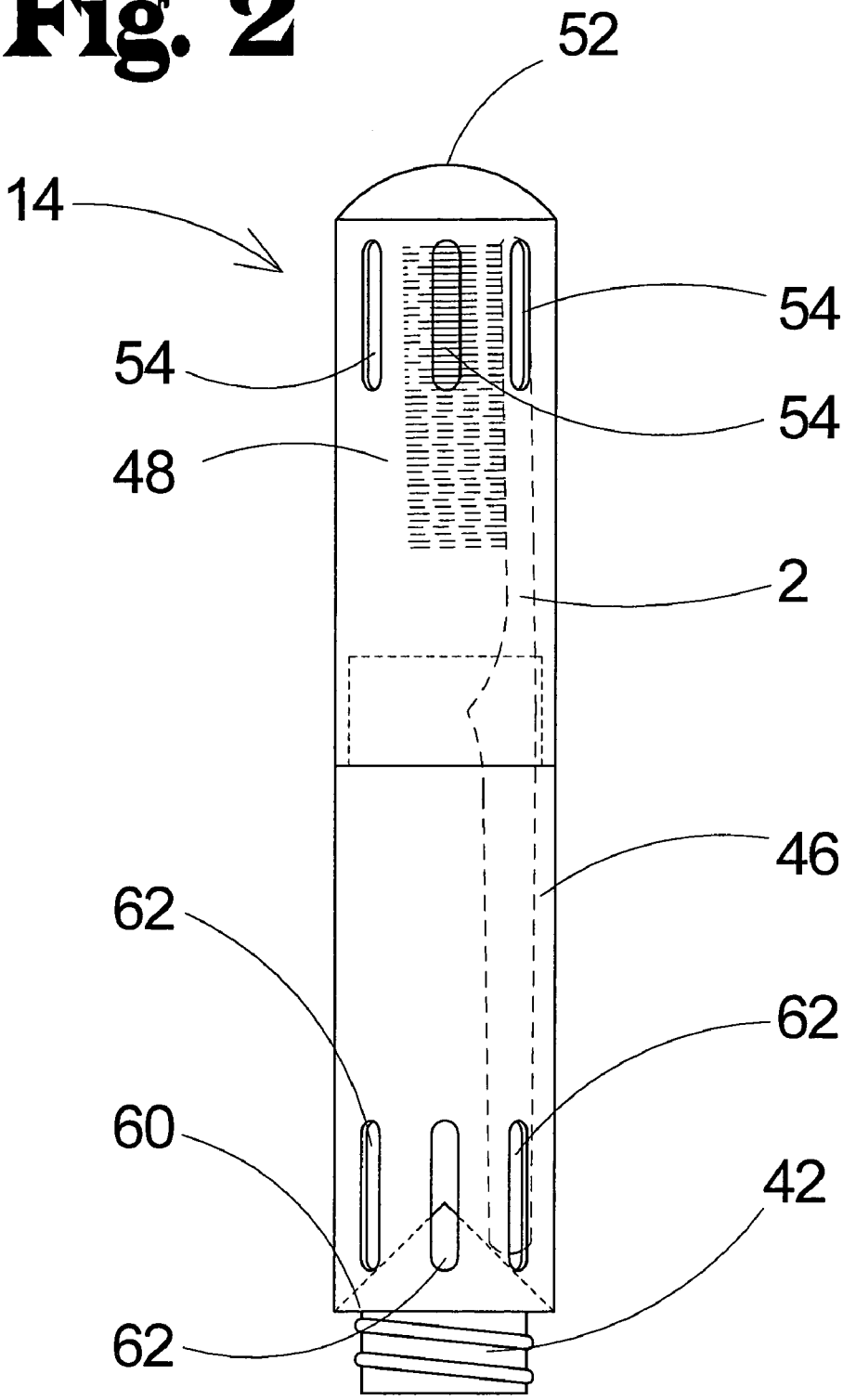
FIG. 2 is a front view of the tubular storage assembly present invention holding a toothbrush.
Figure 3:
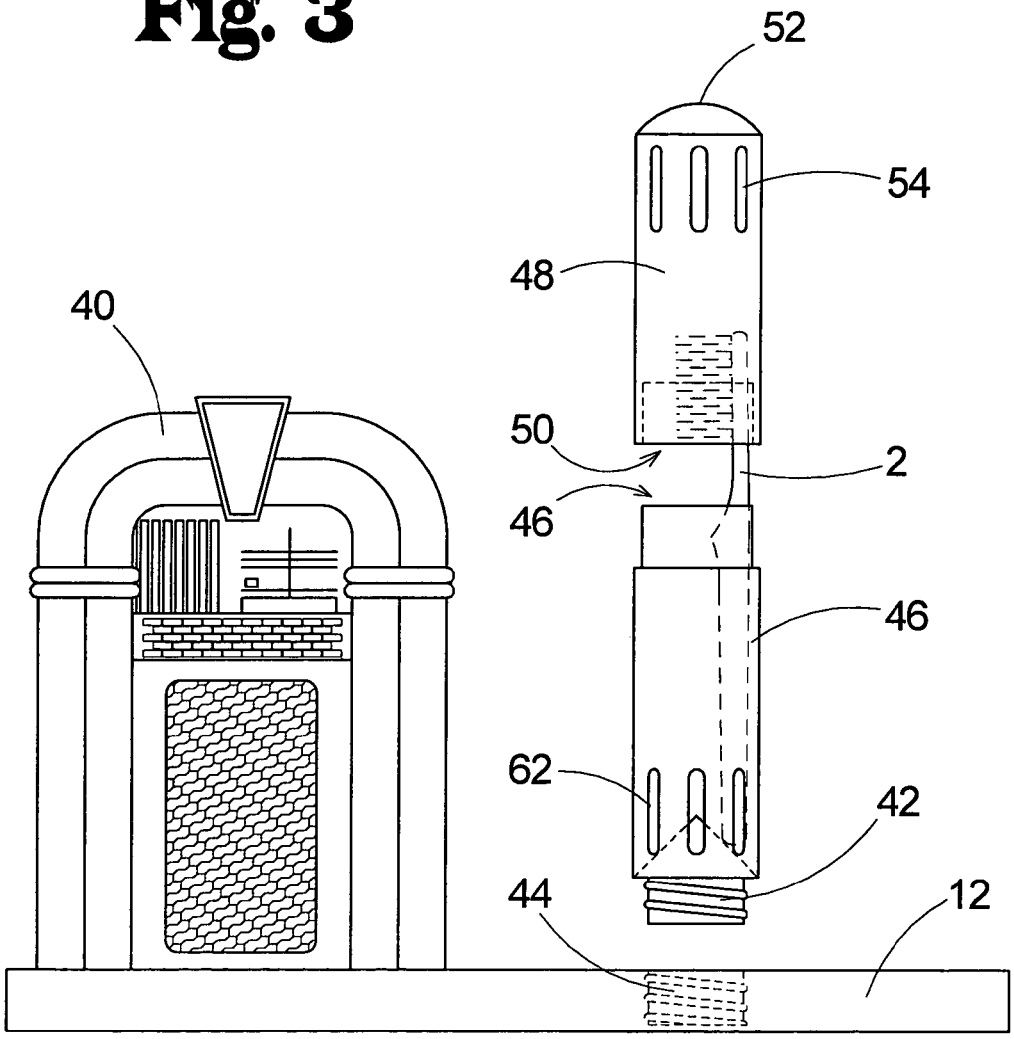
FIG. 3 is a front partially exploded view of an alternate embodiment of the present invention.

With reference now to the drawings, and in particular to FIGS. 1 through 3 thereof, a new dental appliance storage assembly embodying the principles and concepts of the present invention and generally designated by the reference numeral 10 will be described.

As best illustrated in FIGS. 1 through 3, the dental appliance storage assembly 10 generally comprises a base 12 and a tubular storage member 14. The tubular storage member 14 has a conical bottom surface 16 extending into an interior 18 of the tubular storage member 14 such that a toothbrush 2 is urged into a non-vertical orientation when the toothbrush 2 is positioned in the interior 18. The non-vertical orientation promotes the positioning of the toothbrush such that a backing of the head portion rests against the upper interior wall of the tubular storage member with the bristles extending inwardly but not generally touching the interior of the tubular storage member.

A floss dispensing assembly 20 is coupled to the base 12. The floss dispensing assembly 20 is preferably shaped to resemble a human character 22 such as Spiderman or the like. As will become apparent characters associated with the use or production of line, rope, vine, or similar string-like items are particularly appropriate.

The character 22 has a torso portion 24 and an arm portion 26. The torso portion 24 forms a compartment 28 for holding a roll of floss 30. A floss conduit 32 extends from the compartment 28 to an opening 34 in the arm portion 26 such that the floss 30 is threadable through the conduit 32. Thus, the floss 30 appears to be produced from or grasped by the arm portion 26 of the character 22. Typically, the arm portion 26 includes a hand 36. The opening 34 can be positioned anywhere on the arm portion 26 but is most preferably positioned on a wrist area 38 or in the palm of the hand 36.

An audio device 40 is coupled to the base 12 for producing a sound during use. The sound assists in preventing boredom during tooth brushing and flossing. Further, the length of time spent brushing can be associated with the playing of songs to insure that brushing done over a sufficient period of time to maximize effectiveness. The audio device can be an am/fm radio and may further include means such as a CD player, tape player, or the like to play pre-recorded audio sounds. The audio-device can be provided in the shape of a jukebox 56.

The tubular storage member 14 is removable from the base 12 to facilitate taking a toothbrush along during travel. Removability is preferably established using a bottom section 42 of the tubular storage member 14 that is threaded. The base 12 includes a threaded portion 44 complimentary to threading of the tubular storage member 14.

The tubular storage member 14 includes a bottom portion 46 and a top portion 48. The top portion 48 is separable from the bottom portion 46. The top portion 48 has an open bottom 50 couplable to the bottom portion 46, a closed top 52, and a plurality of slits 54 positioned proximate the closed top 52 for providing ventilation into the tubular storage assembly 14 when the top portion 48 is coupled to the bottom portion 46.

The bottom portion 46 has an open top 58 couplable to the top portion 48, a closed bottom 60, and a plurality of slits 62 positioned proximate the closed bottom 60 for providing ventilation into the tubular storage assembly 14 when the top portion 48 is coupled to the bottom portion 46.

Except when mutually exclusive, the variously described elements of the invention are intended to be combined to form additional embodiments such as the embodiment shown in FIG. 3 having an audio device and no floss dispenser.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dental appliance storage assembly comprising:

a base;

a tubular storage member for receiving and storing a manual toothbrush, said tubular storage member having a conical bottom surface extending into an interior of said tubular storage member such that the conical bottom surface urges the manual toothbrush into a vertical orientation when the toothbrush is positioned in said interior and a free lower end of the manual toothbrush contacts and is able to slide along the conical bottom surface as gravity acts on the toothbrush; and a floss dispensing assembly configured to dispense floss and coupled to said base.

2. The dental appliance storage assembly of claim 1 wherein said floss dispensing assembly is shaped to resemble a character.

3. The dental appliance storage assembly of claim 2 wherein said character has a humanoid shape with a torso portion and an arm portion outstretched from the torso portion, said torso portion forming a compartment for holding a roll of floss.

4. The dental appliance storage assembly of claim 3, further comprising:

a floss conduit extending from said compartment through said arm portion to an opening in said arm portion such that the floss is threadable through said conduit whereby the floss appears to be produced from said arm portion of said character.

5. The dental appliance storage assembly of claim 1, further comprising:

an audio device coupled to said base for producing a sound during use.

6. The dental appliance storage assembly of claim 5 wherein said audio device is an am/fm radio.

7. The dental appliance storage assembly of claim 5 wherein said audio device is shaped to resemble a juke box.

8. The dental appliance storage assembly of claim 5 wherein said audio device includes means for playing sounds from a pre-recorded medium.

9. The dental appliance storage assembly of claim 1 wherein said tubular storage member includes a bottom portion and a top portion, said top portion being separable from said bottom portion.

10. The dental appliance storage assembly of claim 9 wherein said top portion has an open bottom couplable to said bottom portion, a closed top, and a plurality of slits positioned proximate said closed top for providing ventilation into said tubular storage assembly when said top portion is coupled to said bottom portion.

11. The dental appliance storage assembly of claim 9 wherein said bottom portion has an open top couplable to said top portion, a closed bottom, and a plurality of slits positioned proximate said closed bottom for providing ventilation into said tubular storage assembly when said top portion is coupled to said bottom portion.

12. The dental appliance storage assembly of claim 1 wherein said tubular storage member is removable from said base.

13. The dental appliance storage assembly of claim 1 wherein a bottom section of said tubular storage member is threaded; and said base including a threaded portion complimentary to said threading of said tubular storage member.

14. The dental appliance storage assembly of claim 1 wherein the conical bottom surface of said tubular storage member biases the free lower end of the manual toothbrush laterally outward toward a perimeter wall of said tubular storage member when the manual toothbrush is positioned in said interior.

15. The dental appliance storage assembly of claim 1 wherein said floss dispensing assembly is shaped to resemble a character;

wherein said character has a humanoid shape with a torso portion and an arm portion outstretched from the torso portion, said torso portion forming a compartment for holding a roll of floss;

a floss conduit extending from said compartment through said arm portion to an opening in said arm portion such that the floss is threadable through said conduit whereby the floss appears to be produced from said arm portion of said character;

an audio device coupled to said base for producing a sound during use, said audio device including an AM/FM radio, said audio device including means for playing sounds from a pre-recorded medium, said audio device being shaped to resemble a juke box;

wherein said tubular storage member is removable from said base, a bottom section of said tubular storage member being threaded, said base including a threaded portion complimentary to said threading of said tubular storage member;

wherein said tubular storage member includes a bottom portion and a top portion, said top portion being separable from said bottom portion, said top portion having an open bottom couplable to said bottom portion, a closed top, and a plurality of slits positioned proximate said closed top for providing ventilation into said tubular storage assembly when said top portion is coupled to said bottom portion;

wherein said bottom portion has an open top couplable to said top portion, a closed bottom, and a plurality of slits positioned proximate said closed bottom for providing ventilation into said tubular storage assembly when said top portion is coupled to said bottom portion; and wherein the conical bottom surface of said tubular storage member biases the free lower end of the manual toothbrush laterally outward toward a perimeter wall of said tubular storage member when the manual toothbrush is positioned in said interior.

* * * * *